US009347361B2

(12) United States Patent
Murakami

(10) Patent No.: US 9,347,361 B2
(45) Date of Patent: May 24, 2016

(54) EXHAUST MANIFOLD MOUNTING STRUCTURE FOR INTERNAL COMBUSTION ENGINE

(71) Applicant: Hiroki Murakami, Toyota (JP)

(72) Inventor: Hiroki Murakami, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/432,272

(22) PCT Filed: Oct. 11, 2013

(86) PCT No.: PCT/IB2013/002337

§ 371 (c)(1),
(2) Date: Mar. 30, 2015

(87) PCT Pub. No.: WO2014/060834

PCT Pub. Date: Apr. 24, 2014

(65) Prior Publication Data

US 2015/0226106 A1 Aug. 13, 2015

(30) Foreign Application Priority Data

Oct. 15, 2012 (JP) ..... 2012-228143

(51) Int. Cl.
*F01N 13/18* (2010.01)
*F01N 13/10* (2010.01)
*F02F 11/00* (2006.01)

(52) U.S. Cl.
CPC ..... *F01N 13/1805* (2013.01); *F01N 13/10* (2013.01); *F01N 13/1822* (2013.01); *F01N 13/1827* (2013.01); *F01N 2450/24* (2013.01); *F02F 11/002* (2013.01)

(58) Field of Classification Search
USPC ..... 60/272, 322, 323, 324; 277/105, 178, 277/183, 212 R, 212 F, 225
See application file for complete search history.

(56) References Cited

U.S. PATENT DOCUMENTS 4,850,189 A * 7/1989 Arthur ..... F01N 13/10 60/313
6,925,862 B2 * 8/2005 Fujita ..... F01N 13/008 73/114.73

(Continued)

FOREIGN PATENT DOCUMENTS

EP 0 744 537 A1 11/1996
JP S62-170891 U 10/1987

(Continued)

OTHER PUBLICATIONS

May 21, 2014 International Search Report issued in International Application No. PCT/IB2013/002337.

(Continued)

*Primary Examiner* — Binh Q Tran
(74) *Attorney, Agent, or Firm* — Oliff PLC

(57) ABSTRACT

A cross recess is provided at a fastening seat portion of a cylinder head in which exhaust port outlets are arranged in two rows and two in each row. A cross protrusion that is fittable to the cross recess is provided at a flange of an exhaust manifold. A gasket has a cross opening through which the cross protrusion is insertable. The exhaust manifold is fastened to the cylinder head by passing the cross protrusion of the flange of the exhaust manifold through the cross opening of the gasket and then fitting the cross protrusion to the cross recess of the fastening seat portion of the cylinder head.

6 Claims, 7 Drawing Sheets

(56) References Cited

U.S. PATENT DOCUMENTS

| | | | | |
|---|---|---|---|---|
| 7,926,852 | B2 * | 4/2011 | Geminn | F01N 13/10 285/124.1 |
| 7,975,473 | B2 * | 7/2011 | Marotta | F01N 13/10 60/274 |
| 8,181,453 | B2 * | 5/2012 | Goplen | F01N 3/34 60/317 |
| 9,080,496 | B2 * | 7/2015 | Demots | F01N 13/1811 |
| 2011/0315098 | A1 | 12/2011 | Kosugi et al. | |

FOREIGN PATENT DOCUMENTS

| | | | |
|---|---|---|---|
| JP | H01-130017 | U | 9/1989 |
| JP | H03-10027 | U | 1/1991 |
| JP | H05-99087 | A | 4/1993 |
| JP | 2002-195031 | A | 7/2002 |
| JP | 2003-083062 | A | 3/2003 |
| JP | 2009-209878 | A | 9/2009 |
| JP | 2009-257157 | A | 11/2009 |
| JP | 2012-031846 | A | 2/2012 |
| JP | 2012-107560 | A | 6/2012 |

OTHER PUBLICATIONS

Aug. 13, 2014 Office Action issued in Japanese Application No. 2012-228143.

* cited by examiner

EXHAUST MANIFOLD MOUNTING STRUCTURE FOR INTERNAL COMBUSTION ENGINE

BACKGROUND OF THE INVENTION

1. Field of the Invention

The invention relates to an exhaust manifold mounting structure for an internal combustion engine. Particularly, the invention relates to a mounting structure of an exhaust manifold on a cylinder head in which exhaust port outlets of cylinders are arranged in multiple rows.

2. Description of Related Art

For example, as is described in Japanese Patent Application Publication No. 2012-31846 (JP 2012-31846 A) and Japanese Patent Application Publication No. 2012-107560 (JP 2012-107560 A), there is suggested an exhaust system structure in which downstream sides of exhaust ports are collected inside a cylinder head. With such an exhaust system structure, the exhaust ports are allowed to be arranged in proximity to a coolant passage in the cylinder head, so it is possible to improve exhaust gas cooling efficiency. In addition, it is possible to narrow an area in which exhaust port outlets are formed at a cylinder head end face (to reduce the length of an area, in which the exhaust port outlets are formed, in a cylinder bank direction), so it is possible to commonalize a connection structure of an exhaust pipe to the cylinder head and a connection structure of a turbocharger to the cylinder head. Thus, it is possible to commonalize a cylinder head between an engine having a turbocharger (turbocharged engine) and an engine having no turbocharger (NA engine).

In addition, not limited to the structure in which the downstream sides of the exhaust ports are collected inside the cylinder head as described in the above publications, similar advantageous effects to the above structure are also obtained when an area in which exhaust port outlets are formed is narrowed by arranging multiple rows of the exhaust port outlets at an end face of a cylinder head while independently forming exhaust ports inside the cylinder head. For example, FIG. 7 (perspective view that shows a cylinder head a and an exhaust manifold b) shows a structure in which, in the case of a four-cylinder engine, exhaust port outlets c, d (e, f) are arranged in two rows and two in each row.

When the exhaust manifold b is mounted on an end face a1 of the cylinder head a at which the multiple rows of exhaust port outlets c, d, e, f are arranged in this way, a flange b1 provided at an upstream end periphery (exhaust gas inlet-side end periphery) of the exhaust manifold b is bolted to the cylinder head a. Specifically, bolt holes b2 are formed at the outer peripheral portion of the flange b1 of the exhaust manifold b, and bolt holes a2 are formed at the end face a1 of the cylinder head a in correspondence with the bolt holes b2. The flange b1 of the exhaust manifold b is placed on the end face a1 of the cylinder head a (for example, placed via a gasket (not shown)), and bolts (not shown) are inserted through the bolt holes b2, a2. Thus, the exhaust manifold b is mounted on the cylinder head a.

Incidentally, in the above mounting structure for the exhaust manifold b, the center portion of the flange b1 cannot be bolted to the cylinder head a, so sufficient sealing performance may not be obtained at the center portion of the flange b1. This is because it is difficult to insert an assembling tool (driver, or the like) to the center portion of the flange b1 (it is difficult to insert an assembling tool because there are pipes (branch pipes) b3 of the exhaust manifold b) and, therefore, the center portion of the flange b1 cannot be bolted to the cylinder head a.

SUMMARY OF THE INVENTION

The invention provides an exhaust manifold mounting structure that is able to sufficiently ensure sealing performance when an exhaust manifold is mounted on a cylinder head in which exhaust port outlets are arranged in multiple rows.

An aspect of the invention is that, when a flange of an exhaust manifold is mounted on an end face of a cylinder head in which exhaust port outlets are arranged in multiple rows, a recess is provided in correspondence with an area in between any adjacent two of the exhaust port outlets at one of the end face of the cylinder head and the flange of the exhaust manifold (an end face of the flange, which is placed on the cylinder head), and a protrusion is provided in correspondence with an area in between any adjacent two of the exhaust port outlets at the other one of the end face of the cylinder head and the flange of the exhaust manifold, and sealing performance between the end face of the cylinder head and the end face of the flange of the exhaust manifold is ensured by a labyrinth structure obtained by fitting the protrusion to the recess.

An aspect of the invention relates to an exhaust manifold mounting structure for an internal combustion engine, which mounts an exhaust manifold on an end face of a cylinder head in which exhaust port outlets are arranged in multiple rows and a plurality of the exhaust port outlets are arranged in each row. With the exhaust manifold mounting structure, a fastening seat portion is formed on the end face of the cylinder head, the plurality of exhaust port outlets are arranged at the fastening seat portion, and the exhaust manifold is formed on the fastening seat portion. A flange is provided at the exhaust manifold, a plurality of exhaust gas introduction openings corresponding to the exhaust port outlets are provided at the flange, and the flange is formed in a shape corresponding to the fastening seat portion. A recess is provided at one of the fastening seat portion of the cylinder head and the flange of the exhaust manifold in correspondence with an area in between any adjacent two of the exhaust port outlets, and a protrusion that is fitted to the recess is provided at the other one of the fastening seat portion of the cylinder head and the flange of the exhaust manifold, and the exhaust manifold is fastened to the cylinder head by placing the flange of the exhaust manifold on the fastening seat portion of the cylinder head in a state where the protrusion is fitted to the recess.

According to the above aspect, in a state where the exhaust manifold is fastened to the cylinder head by placing the flange of the exhaust manifold on the fastening seat portion of the cylinder head, the protrusion provided at the other one of the fastening seat portion of the cylinder head and the flange of the exhaust manifold is fitted to the recess provided at the one of the fastening seat portion of the cylinder head and the flange of the exhaust manifold. That is, mating surfaces of the end face (fastening seat portion) of the cylinder head and the flange (end face of the flange) of the exhaust manifold are placed on top of each other by protrusion and recess surfaces. Therefore, a labyrinth structure (seal structure formed through placement of the protrusion and recess surfaces on top of each other) is present between any adjacent two of the exhaust port outlets and between any adjacent two of the exhaust gas introduction openings, so sealing performance between any adjacent two of the exhaust port outlets and between any adjacent two of the exhaust gas introduction openings is favorably ensured. Therefore, exhaust gas emitted from any one of the exhaust port outlets does not flow into the exhaust gas introduction openings other than the exhaust gas introduction opening corresponding to the any one of the exhaust port outlets to influence the exhaust gas emission performance.

In the aspect of the invention, a knock-pin may be provided at a center portion of the fastening seat portion of the cylinder head. An insertion hole to which the knock-pin is inserted may be provided at a center portion of the flange of the exhaust manifold. The knock-pin may be inserted in the insertion hole in a state where the flange of the exhaust manifold is placed on the fastening seat portion of the cylinder head.

According to the above aspect, the relative locations of the fastening seat portion of the cylinder head and the flange of the exhaust manifold are positioned in a state where the knock-pin is inserted in the insertion hole, so the mounting location of the exhaust manifold on the cylinder head is appropriately obtained, and a positional deviation does not occur in these relative locations. In addition, the knock-pin is provided at the center portion of the fastening seat portion, so, even when thermal expansion occurs in the fastening seat portion of the cylinder head or the flange of the exhaust manifold, the relative locations of these members are appropriately positioned with almost no influence.

In addition, mounting holes that allow bolts for fastening the flange to the cylinder head to be inserted may be formed at multiple portions of an outer peripheral portion of the flange of the exhaust manifold, and at least one of the plurality of mounting holes may be an oblong hole that extends in a direction outward from a center location of the flange.

According to the above aspect, when thermal expansion occurs in the cylinder head or the exhaust manifold, the relative locations of the bolt and the mounting hole formed in the oblong hole vary in the extending direction of the oblong hole. That is, thermal expansion of the cylinder head or the exhaust manifold is absorbed by the oblong hole, and pressing of the bolt against the inner periphery of the mounting hole (oblong hole) is suppressed, so it is possible to alleviate thermal stress that acts on the cylinder head and the exhaust manifold.

In a configuration of the case where the invention is applied to a four-cylinder internal combustion engine, the four exhaust port outlets may be arranged in two rows and two in each of the two rows at the fastening seat portion of the cylinder head. A recess provided at one of the fastening seat portion of the cylinder head and the flange of the exhaust manifold and a protrusion provided at the other one of the fastening seat portion of the cylinder head and the flange of the exhaust manifold each may be formed in between the two rows and in between any adjacent two of the exhaust port outlets in each row.

According to the above aspect, sealing performance in the area in between any adjacent two of the four exhaust port outlets is favorably ensured.

As for locations at which the recess and the protrusion are formed, the recess may be provided at the fastening seat portion of the cylinder head, and the protrusion may be provided at the flange of the exhaust manifold.

In addition, a gasket may be interposed between the fastening seat portion of the cylinder head and the flange of the exhaust manifold, and the gasket may have an opening through which the protrusion is inserted.

Thus, it is possible to attain both sealing performance through the above-described labyrinth structure and sealing performance through the gasket, so it is possible to ensure high sealing performance overall between the fastening seat portion of the cylinder head and the flange of the exhaust manifold.

In the aspect of the invention, a sealing structure through placement of the recess and protrusion surfaces on top of each other between the cylinder head and the flange of the exhaust manifold. Thus, it is possible to ensure favorable sealing performance in between any adjacent two of the exhaust port outlets of the cylinder head and in between any adjacent two of the exhaust gas introduction openings of the flange.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 6A and FIG. 6B are sectional views of the cylinder head, gasket and exhaust manifold, taken along the line VI-VI in FIG. 1, in which FIG. 6A is a view for illustrating work for mounting the exhaust manifold on the cylinder head and FIG. 6B is a view that shows a state where the exhaust manifold is mounted on the cylinder head.

DETAILED DESCRIPTION OF EMBODIMENTS

Hereinafter, an embodiment of the invention will be described with reference to the accompanying drawings. The present embodiment will be described on the case where the invention is applied to a gasoline engine (internal combustion engine) mounted on an automobile as an example.

Figure 1:
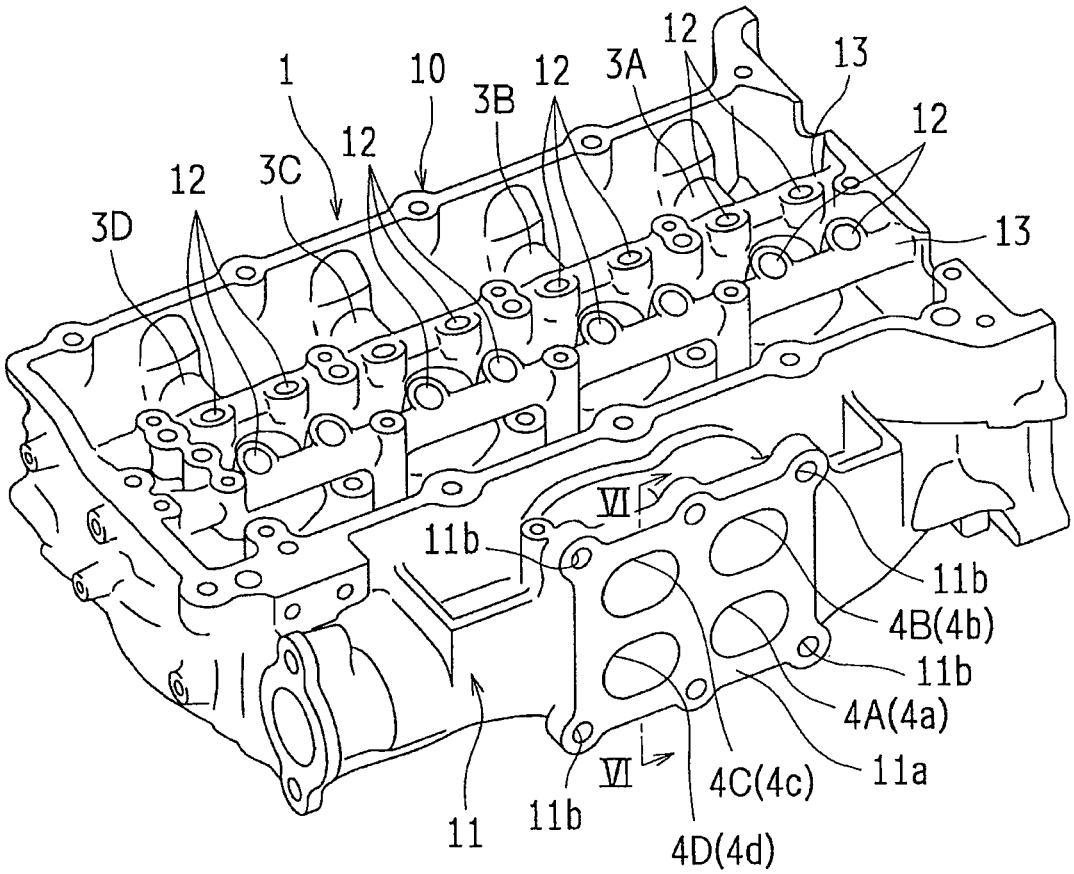
FIG. 1 is a perspective view of a cylinder head according to an embodiment when viewed from an obliquely upper side of an exhaust side.

FIG. 1 is a perspective view of a cylinder head 1 of the gasoline engine according to the embodiment of the invention when viewed from an obliquely upper side of an exhaust side. The cylinder head 1 is assembled to the upper portion of a cylinder block (not shown). The cylinder head 1 closes the upper ends of four cylinders 2A, 2B, 2C, 2D (cylinders, see FIG. 2) formed in the cylinder block, and defines combustion chambers between the cylinder head 1 and pistons (not shown) respectively fitted in the cylinders 2A, 2B, 2C, 2D.

Figure 2:
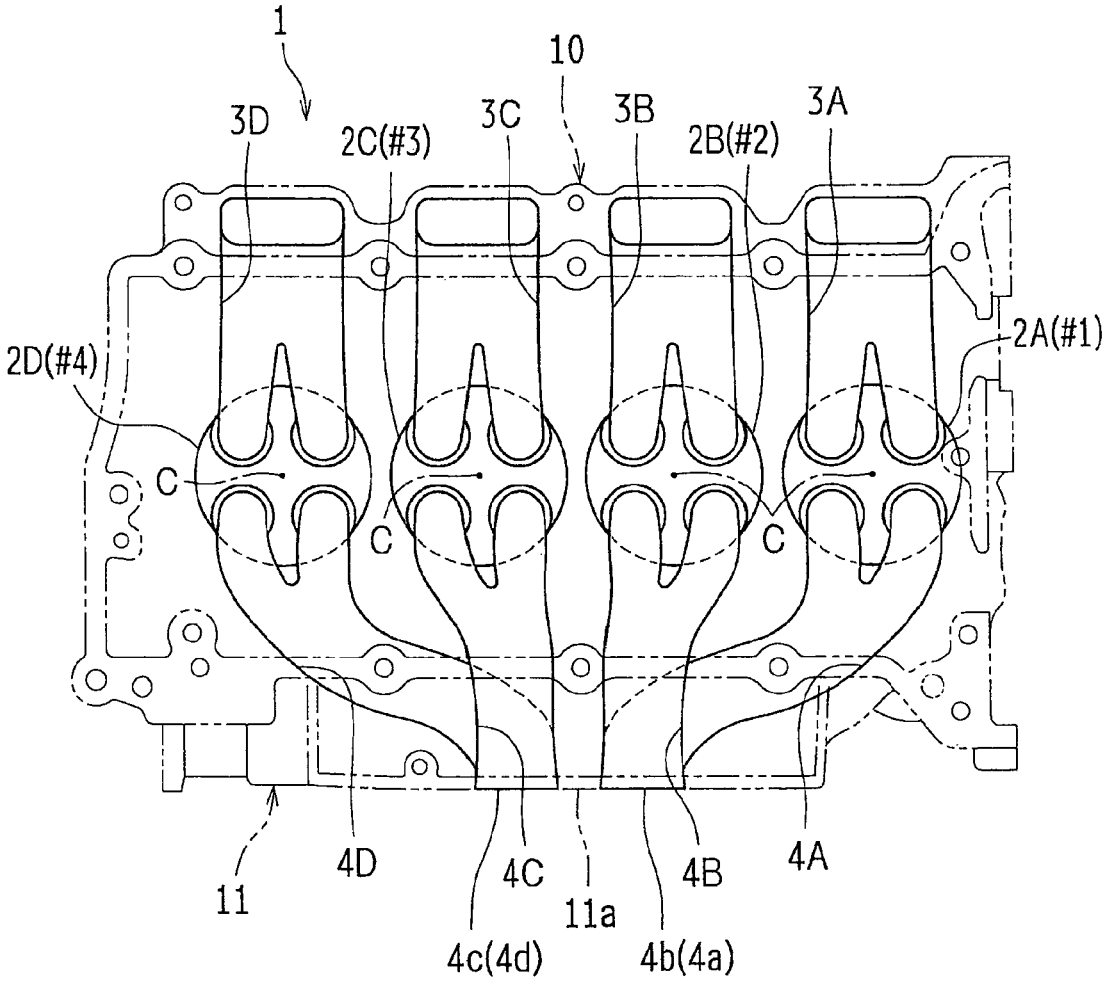
FIG. 2 is a view that illustrates an overall layout of cylinders, exhaust ports, and the like, when the cylinder head according to the embodiment is seen through from an upper side.

In the engine according to the present embodiment, the four cylinders 2A, 2B, 2C, 2D are arranged in line when seen through from an upper side in FIG. 2 as an example. In the following description, in order from one end of the cylinder head 1 in the longitudinal direction (that is, cylinder bank direction) to the other end (from right to left in FIG. 2), the cylinders are termed first cylinder 2A (#1), second cylinder 2B (#2), third cylinder 2C (#3) and fourth cylinder 2D (#4). Although not shown in the drawing, shallow recesses serving as ceiling portions of the combustion chambers of the respective cylinders are formed at the lower face of the cylinder head 1, and the downstream ends of intake ports 3A, 3B, 3C, 3D and the upstream ends of exhaust ports 4A, 4B, 4C, 4D are respectively open to the corresponding recesses.

That is, as shown in FIG. 2, the four intake ports 3A, 3B, 3C, 3D for respectively introducing air to the combustion chambers of the cylinders 2A, 2B, 2C, 2D are open at an intake-side, side wall 10 of the cylinder head 1, that is, the far side in FIG. 1, and an intake manifold (not shown) is connected to the intake-side side wall 10. On the other hand, the four exhaust ports 4A, 4B, 4C, 4D for respectively emitting burned gas from the combustion chambers of the cylinders 2A, 2B, 2C, 2D are open at an exhaust-side side wall 11 of the cylinder head 1, that is, the near side in FIG. 1, and an exhaust manifold 5 (described later) (see FIG. 3) is connected to the exhaust-side side wall 11.

The four exhaust ports 4A, 4B, 4C, 4D that are longer than normal exhaust ports are formed inside the cylinder head 1 according to the present embodiment. A substantially rectangular fastening seat portion (portion that serves as a fastening seat to which the exhaust manifold 5 is fastened) 11*a* is formed at substantially the center of the exhaust-side side wall 11 in the longitudinal direction as shown in FIG. 1, and the four exhaust ports 4A, 4B, 4C, 4D are open two by two vertically and horizontally at the fastening seat portion 11*a*.

That is, the two outer exhaust ports 4A, 4D are open side by side in the cylinder bank direction at the lower half portion of the fastening seat portion 11*a*, and the two inner exhaust ports 4B, 4C are open side by side in the cylinder bank direction at the upper half portion of the fastening seat portion 11*a*. In the following description, the downstream-side openings of these exhaust ports 4A, 4B, 4C, 4D are termed "exhaust port outlets", the opening of the exhaust port 4A that communicates with the first cylinder 2A is termed a first exhaust port outlet 4*a*, the opening of the exhaust port 4B that communicates with the second cylinder 2B is termed a second exhaust port outlet 4*b*, the opening of the exhaust port 4C that communicates with the third cylinder 2C is termed a third exhaust port outlet 4*c*, and the opening of the exhaust port 4D that communicates with the fourth cylinder 2D is termed a fourth exhaust port outlet 4*d*. In this way, in the present embodiment, the exhaust port outlets 4*a*, 4*d* (4*b*, 4*c*) are arranged in two rows and two in each row.

The bolt holes 11*b* are respectively formed at the four corners of the fastening seat portion 11*a* and the centers of the upper periphery and lower periphery of the fastening seat portion 11*a*, and the flange 6 of the exhaust manifold 5 (described later) is placed on the fastening seat portion 11*a* and fastened to the fastening seat portion 11*a* (this fastening structure will be described later).

Although not shown in the drawing, a DOHC-type valve actuating system having a camshaft is arranged at each of the intake side and the exhaust side at the upper portion of the cylinder head 1. Reference numeral 12 shown in FIG. 1 denotes accommodating holes for hydraulic lash adjusters (HLAs) provided two at the intake side and two at the exhaust side for each of the cylinders 2A to 2D. Reference numeral 13 denotes portions that form passages that respectively supply oil to each of the HLAs of the intake side and exhaust side.

As shown in FIG. 2, when the cylinder head 1 is seen through from above, the exhaust gas flow upstream end of each of the four exhaust ports 4A to 4D is branched into two and individually communicate with a corresponding one of the cylinders 2A to 2D. On the other hand, the midstream and downstream of each of the exhaust ports 4A to 4D are not branched, and the exhaust ports 4A to 4D extend through the exhaust-side side wall 11 without joining with any adjacent exhaust ports 4A to 4D and are individually open at the fastening seat portion 11*a* as described above.

That is, among the four exhaust ports 4A to 4D, the outer exhaust ports 4A, 4D (outer passages) that respectively communicate with both outer first and fourth cylinders 2A, 2D in the cylinder bank direction are curved at a relatively large curvature radius so as to gradually approach the center in the cylinder bank direction from the exhaust gas flow upstream side toward the downstream side, in other words, so as to approach inward in the cylinder bank direction, when viewed vertically (in the direction of the cylinder center line C) as shown in FIG. 2.

In contrast to this, the inner exhaust ports 4B, 4C (inner passages) that respectively communicate with the second and third cylinders 2B, 2C located at the inner side in the cylinder bank direction extend substantially straight from the second and third cylinders 2B, 2C toward the fastening seat portion 11*a* of the exhaust-side side wall 11 when viewed from above as shown in FIG. 2.

Mounting Structure of Exhaust Manifold

Next, the mounting structure of the exhaust manifold 5 that is a feature of the present embodiment will be described.

Figure 3:
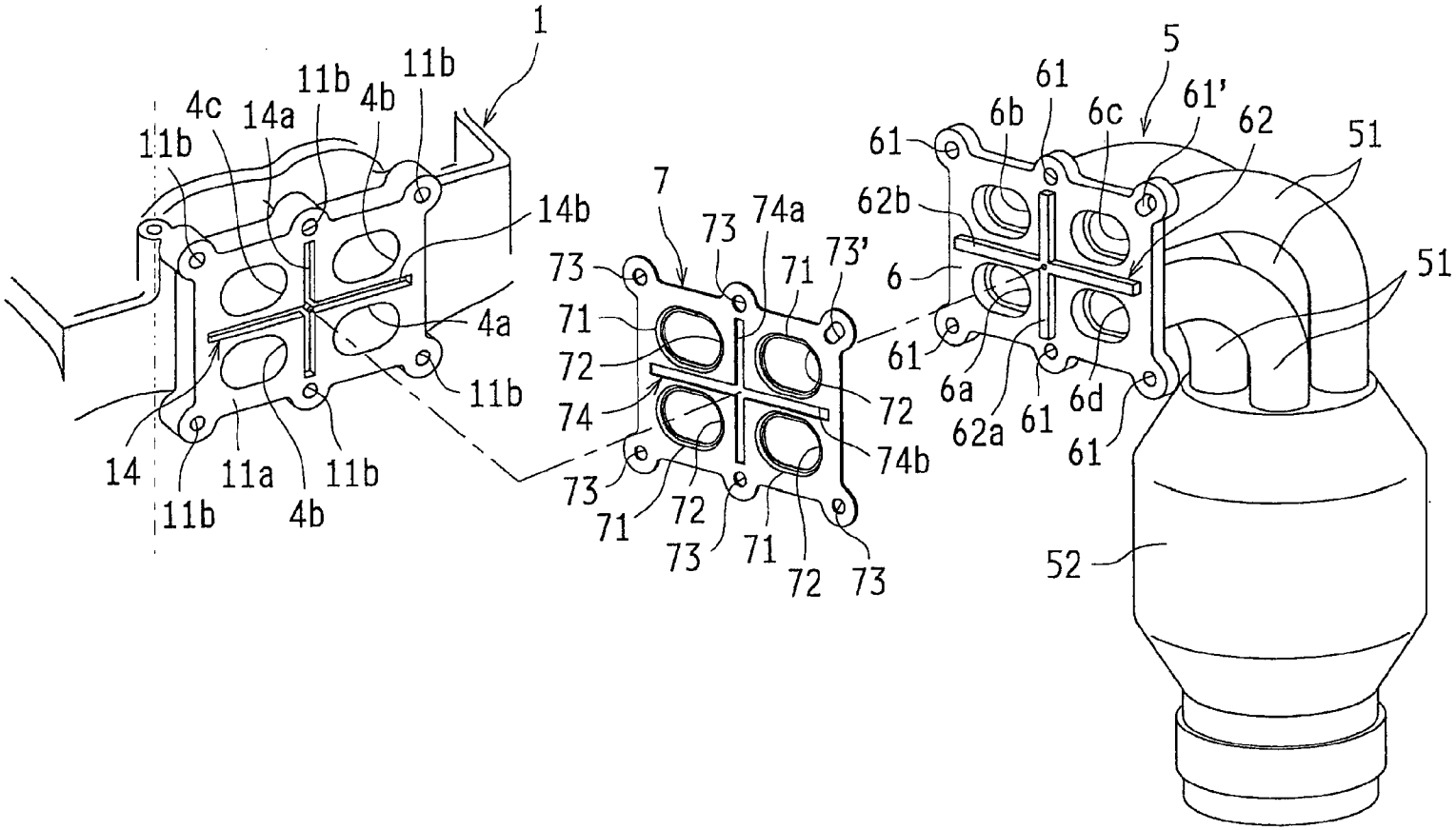
FIG. 3 is a perspective view for illustrating work for mounting an exhaust manifold on the cylinder head.
Figure 4:
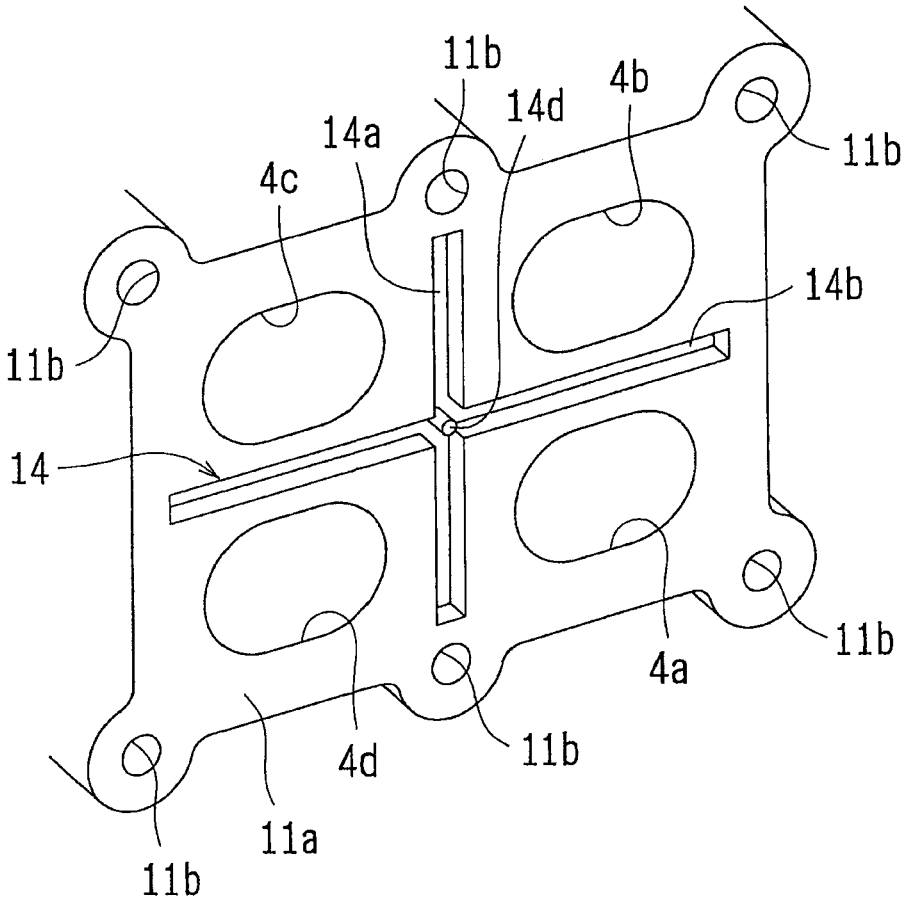
FIG. 4 is a perspective view that shows a fastening seat portion provided in the cylinder head.
Figure 5:
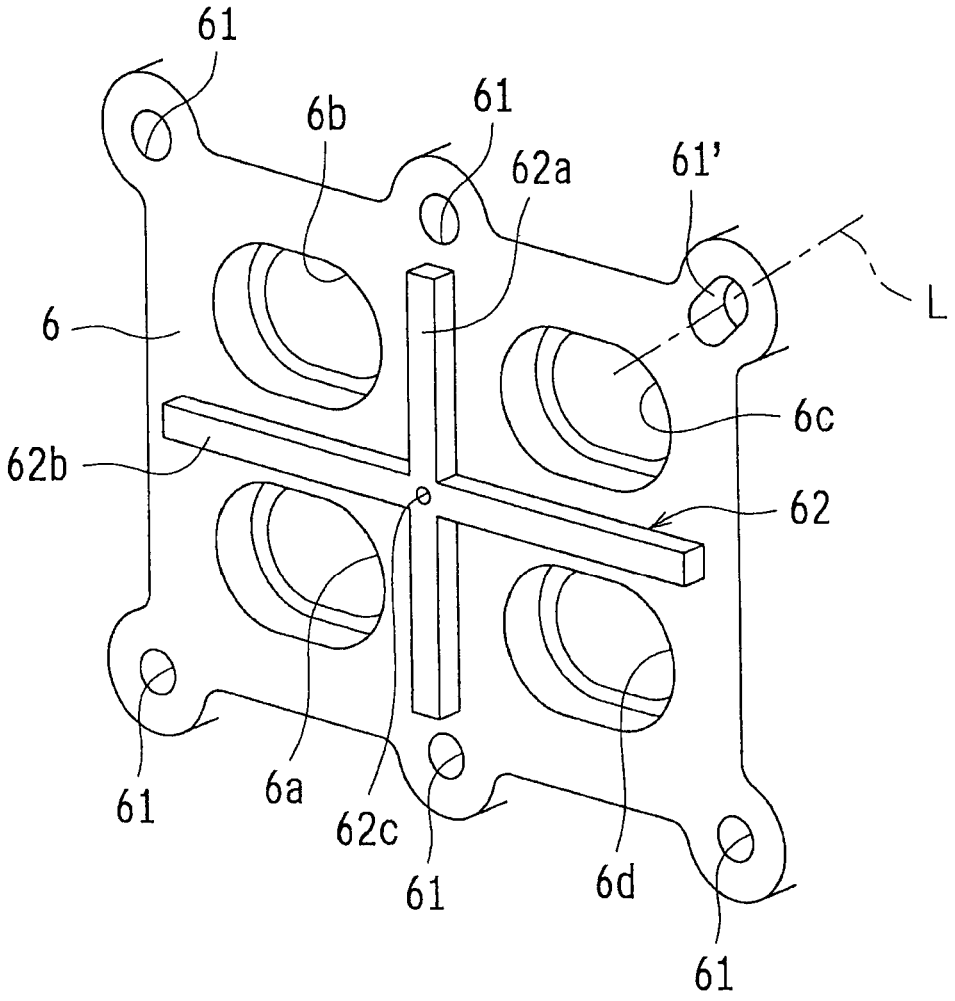
FIG. 5 is a perspective view that shows a flange of the exhaust manifold.

FIG. 3 is a perspective view for illustrating work for mounting the exhaust manifold 5 on the cylinder head 1. FIG. 4 is a perspective view that shows the fastening seat portion 11*a* (portion on which the flange 6 of the exhaust manifold 5 is mounted) provided at the cylinder head 1. Furthermore, FIG. 5 is a perspective view that shows the flange 6 of the exhaust manifold 5. Hereinafter, the members will be described.

As described above, the four exhaust port outlets 4*a*, 4*b*, 4*c*, 4*d* are provided at the fastening seat portion 11*a* provided at the cylinder head 1, and these exhaust port outlets 4*a*, 4*b*, 4*c*, 4*d* are arranged in two rows and two in each row.

The feature of the fastening seat portion 11*a* in the cylinder head 1 is that a cross recess 14 is formed to extend in between the adjacent two of the exhaust port outlets 4*a*, 4*b*, 4*c*, 4*d*. That is, the cross recess 14 is formed in correspondence with an area between any adjacent two of the exhaust port outlets 4*a*, 4*b*, 4*c*, 4*d* in the vertical direction, the horizontal direction and the oblique direction.

Specifically, a vertical groove 14*a* extending vertically and a horizontal groove 14*b* extending horizontally are formed so as to partition the area in which the exhaust port outlets 4*a*, 4*b*, 4*c*, 4*d* are formed, and the cross recess 14 is formed such that the longitudinal center portions of these grooves 14*a*, 14*b* are overlapped.

The vertical groove 14*a* extends vertically from the area between the first exhaust port outlet 4*a* located at the lower right in the drawing and the fourth exhaust port outlet 4*d* located at the lower left in the drawing in the fastening seat portion 11*a* to the area between the second exhaust port outlet 4*b* located at the upper right in the drawing and the third exhaust port outlet 4*c* located at the upper left in the drawing.

On the other hand, the horizontal groove 14*b* extends horizontally from the area between the first exhaust port outlet 4*a* located at the lower right in the drawing and the second exhaust port outlet 4*b* located at the upper right in the drawing to the area between the fourth exhaust port outlet 4*d* located at the lower left in the drawing and the third exhaust port outlet 4*c* located at the upper left in the drawing.

The longitudinal end periphery locations of these vertical groove 14*a* and horizontal groove 14*b* are set back by a predetermined size from the end periphery locations of the fastening seat portion 11*a* in the cylinder head 1. That is, the longitudinal end peripheries of the vertical groove 14*a* and horizontal groove 14*b* are not open at the end peripheries of the fastening seat portion 11*a*.

Specifically, for example, the upper end location of the vertical groove 14*a* substantially coincides with the upper end locations of the second exhaust port outlet 4*b* and third exhaust port outlet 4*c*. In addition, the lower end location of the vertical groove 14*a* substantially coincides with the lower end locations of the first exhaust port outlet 4*a* and fourth exhaust port outlet 4*d*. Similarly, the left end location of the horizontal groove 14*b* in the drawing substantially coincides with the left end locations of the third exhaust port outlet 4*c* and fourth exhaust port outlet 4*d* in the drawing. In addition, the right end location of the horizontal groove 14*b* in the drawing substantially coincides with the right end locations of the first exhaust port outlet 4*a* and second exhaust port outlet 4*b* in the drawing.

Not limited to this configuration, the upper end location of the vertical groove 14*a* may be located slightly upward or may be located slightly downward with respect to the upper end locations of the second exhaust port outlet 4*b* and third exhaust port outlet 4*c*. In addition, the lower end location of the vertical groove 14*a* may be located slightly upward or may be located slightly downward with respect to the lower end locations of the first exhaust port outlet 4*a* and fourth exhaust port outlet 4*d*. Similarly, the left end location of the horizontal groove 14*b* in the drawing may be located slightly leftward or may be located slightly rightward with respect to the left end locations of the third exhaust port outlet 4*c* and fourth exhaust port outlet 4*d* in the drawing. In addition, the right end location of the horizontal groove 14*b* in the drawing may be located slightly rightward or may be located slightly leftward with respect to the right end locations of the first exhaust port outlet 4*a* and second exhaust port outlet 4*b*.

A knock-pin hole 14*c* (see the cross section of the cylinder head 1 shown in FIG. 6A and FIG. 6B) extending in a direction perpendicular to the end face of the fastening seat portion 11*a* is formed at the bottom face of the recess 14 at the center portion of the fastening seat portion 11*a*, that is, the intersecting portion of these vertical groove 14*a* and horizontal groove 14*b*, and a knock-pin 14*d* is inserted in the knock-pin hole 14*c*. The outside diameter of the knock-pin 14*d* may be selectively set. In the present embodiment, the outside diameter of the knockpin 14*d* is set to about one third of the width of each of the grooves 14*a*, 14*b*. In addition, the distal end location of the knock-pin 14*d* in a state where the knock-pin 14*d* is inserted in the knock-pin hole 14*c* substantially coincides with the end face location of the fastening seat portion 11*a* (see FIG. 6A). That is, the depth of the recess 14 substantially coincides with a difference between the length of the knock-pin 14*d* and the depth of the knock-pin hole 14*c*.

Four exhaust gas introduction openings 6*a*, 6*b*, 6*c*, 6*d* corresponding to the four exhaust port outlets 4*a*, 4*b*, 4*c*, 4*d* provided at the fastening seat portion 11*a* of the cylinder head 1 are formed at the flange 6 provided at the upstream end location of the exhaust manifold 5. That is, these exhaust gas introduction openings 6*a*, 6*b*, 6*c*, 6*d* are also arranged in two rows and two in each row. Bolt holes (mounting holes) 61 corresponding to the bolt holes 11*b* formed in the fastening seat portion 11*a* of the cylinder head 1 are respectively provided at the four corners and the centers of the upper periphery and lower periphery in the flange 6. In FIG. 3, reference numeral 51 denotes branch pipes of the exhaust manifold 5, and reference numeral 52 denotes a catalytic converter (for example, three-way catalyst).

The flange 6 of the exhaust manifold 5 has a cross protrusion 62 that extends in between the adjacent two of the exhaust gas introduction openings 6*a*, 6*b*, 6*c*, 6*d*. The protrusion 62 substantially coincides with the shape of the recess 14 formed at the fastening seat portion 11*a* or is slightly smaller than the shape of the recess 14.

Specifically, a vertical protrusion 62*a* extending vertically and a horizontal protrusion 62*b* extending horizontally are formed so as to partition the area in which the exhaust gas introduction openings 6*a*, 6*b*, 6*c*, 6*d* are formed, and the cross protrusion 62 is formed such that the longitudinal center portions of the protrusion 62*a* is overlapped with the longitudinal center portion of the protrusion 62*b*.

The vertical protrusion 62*a* extends vertically from the area between the first exhaust gas introduction opening 6*a* corresponding to the first exhaust port outlet 4*a* and the fourth exhaust gas introduction opening 6*d* corresponding to the fourth exhaust port outlet 4*d* to the area between the second exhaust gas introduction opening 6*b* corresponding to the second exhaust port outlet 4*b* and the third exhaust gas introduction opening 6*c* corresponding to the third exhaust port outlet 4*c*.

On the other hand, the horizontal protrusion 62*b* extends horizontally from the area between the first exhaust gas introduction opening 6*a* and the second exhaust gas introduction opening 6*b* to the area between the third exhaust gas introduction opening 6*c* and the fourth exhaust gas introduction opening 6*d*.

In addition, the longitudinal end periphery locations of these vertical protrusion 62*a* and horizontal protrusion 62*b* are set back by a predetermined size from the end periphery location of the flange 6 of the exhaust manifold 5. That is, the longitudinal end peripheries of the vertical protrusion 62*a* and horizontal protrusion 62*b* do not reach the end periphery of the flange 6.

Specifically, for example, the upper end location of the vertical protrusion 62*a* substantially coincides with the upper end locations of the second exhaust gas introduction opening 6*b* and third exhaust gas introduction opening 6*c*. In addition, the lower end location of the vertical protrusion 62*a* substantially coincides with the lower end locations of the first exhaust gas introduction opening 6*a* and fourth exhaust gas introduction opening 6*d*. Similarly, the left end location of the horizontal protrusion 62*b* in the drawing substantially coincides with the left end locations of the first exhaust gas introduction opening 6*a* and second exhaust gas introduction opening 6*b* in the drawing. In addition, the right end location of the horizontal protrusion 62*b* in the drawing substantially coincides with the right end locations of the third exhaust gas introduction opening 6*c* and fourth exhaust gas introduction opening 6*d* in the drawing.

Not limited to this configuration, the upper end location of the vertical protrusion 62*a* may be located slightly upward or may be located slightly downward with respect to the upper end locations of the second exhaust gas introduction opening 6*b* and third exhaust gas introduction opening 6*c*. In addition, the lower end location of the vertical protrusion 62*a* may be located slightly upward or may be located slightly downward with respect to the lower end locations of the first exhaust gas introduction opening 6*a* and fourth exhaust gas introduction opening 6*d*. Similarly, the left end location of the horizontal protrusion 62*b* in the drawing may be located slightly leftward or may be located slightly rightward with respect to the left end locations of the first exhaust gas introduction opening 6*a* and second exhaust gas introduction opening 6*b* in the drawing. In addition, the right end location of the horizontal protrusion 62*b* in the drawing may be located slightly rightward or may be located slightly leftward with respect to the right end locations of the third exhaust gas introduction opening 6*c* and fourth exhaust gas introduction opening 6*d*.

A knock-pin hole (insertion hole) 62*c* in which the knock-pin 14*d* is insertable is formed at the end face of the protrusion 62 at the center portion of the flange 6, that is, the intersecting portion of these vertical protrusion 62*a* and horizontal protrusion 62*b*. The inside diameter of the knock-pin hole 62*c* coincides with the outside diameter of the knock-pin 14*d* or is set so as to be slightly larger than the outside diameter of the knock-pin 14*d*.

One of the bolt holes 61 formed in the flange 6 of the exhaust manifold 5 is an oblong hole 61'. In the present embodiment, the bolt hole provided at the upper right in the drawing (provided at a location closest to the third exhaust gas introduction opening 6*c*) is the oblong hole 61'. The extending direction of the oblong hole 61' substantially coincides with the extending direction of a straight line that extends outward from the center location (location at which the knock-pin hole 62*c* is formed) of the flange 6 of the exhaust manifold 5 (see a straight line L indicated by the alternate long and short dashed line in FIG. 5).

The bolt holes (five bolt holes in the present embodiment) 61 other than the bolt hole formed in the oblong hole 61' are formed so as to be slightly larger than the inside diameter of each of the bolt holes 11*b* formed in the cylinder head 1 (smaller than the outside diameter of the head of each bolt B (described later)).

A gasket 7 (see FIG. 3) interposed between the fastening seat portion 11*a* of the cylinder head 1 and the flange 6 of the exhaust manifold 5 is formed by laminating a plurality of (for example, two) sheet members made of a metal (for example, stainless steel). The gasket 7 may be formed of a single sheet member.

The gasket 7 has exhaust gas openings 72 at locations corresponding to the exhaust port outlets 4*a* to 4*d* of the cylinder head 1 and the exhaust gas introduction openings 6*a* to 6*d* of the flange 6 of the exhaust manifold 5, and has bolt insertion holes 73 corresponding to the bolt holes 11*b*, 61. The inside diameter of each of the bolt insertion holes 73, for example, substantially coincides with the inside diameter of each of the bolt holes 11*b* formed in the fastening seat portion 11*a*. In addition, a bolt insertion hole 73' corresponding to the oblong hole 61' formed in the flange 6 of the exhaust manifold 5 is also a similar oblong hole.

Furthermore, the gasket 7 has bent portions 71 called beads at portions corresponding to a peripheral portion of an area that is required to prevent leakage of exhaust gas (peripheral portions of the exhaust port outlets 4*a*, 4*b*, 4*c*, 4*d*). Thus, when the gasket 7 is sandwiched between the fastening seat portion 11*a* of the cylinder head 1 and the flange 6 of the exhaust manifold 5, the degree of adhesion increases through compression deformation of the beads 71. Thus, high sealing performance is obtained.

The feature of the gasket 7 has a cross opening 74 corresponding to the cross recess 14 and the cross protrusion 62. The cross opening 74 has a vertical opening 74*a* extending vertically and a horizontal opening 74*b* extending horizontally. The shapes of these vertical opening 74*a* and horizontal opening 74*b* substantially coincide with the shapes of the vertical protrusion 62*a* and horizontal protrusion 62*b* that constitute the cross protrusion 62 formed at the flange 6 of the exhaust manifold 5 or are slightly larger than the shapes of these vertical protrusion 62*a* and horizontal protrusion 62*b*.

Next, work for mounting the exhaust manifold 5 on the cylinder head 1 will be described.

Figure 6A:
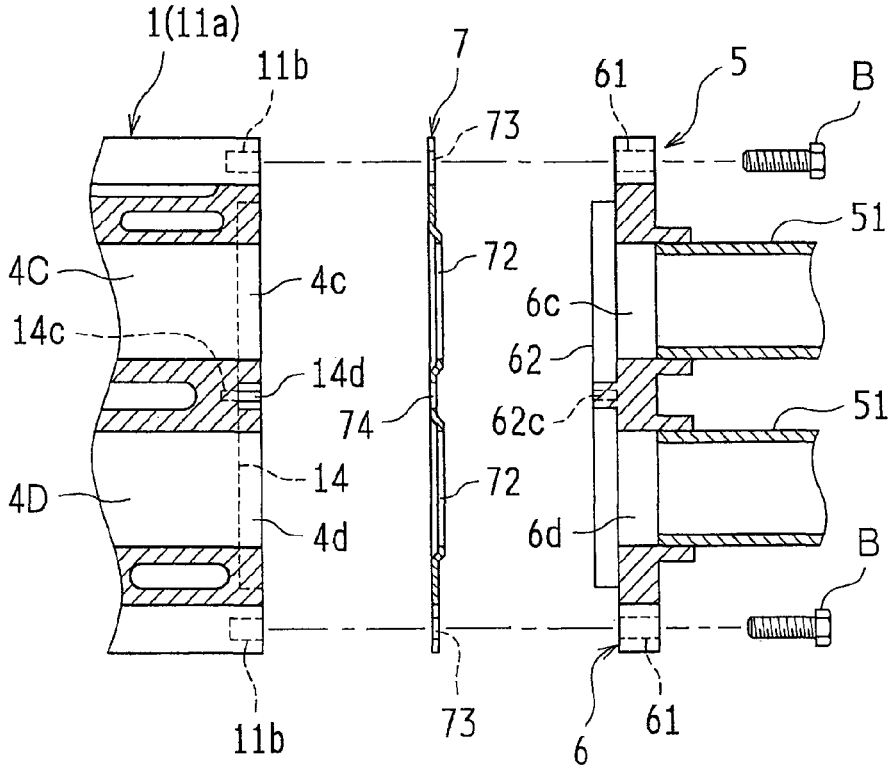
Figure 6B:
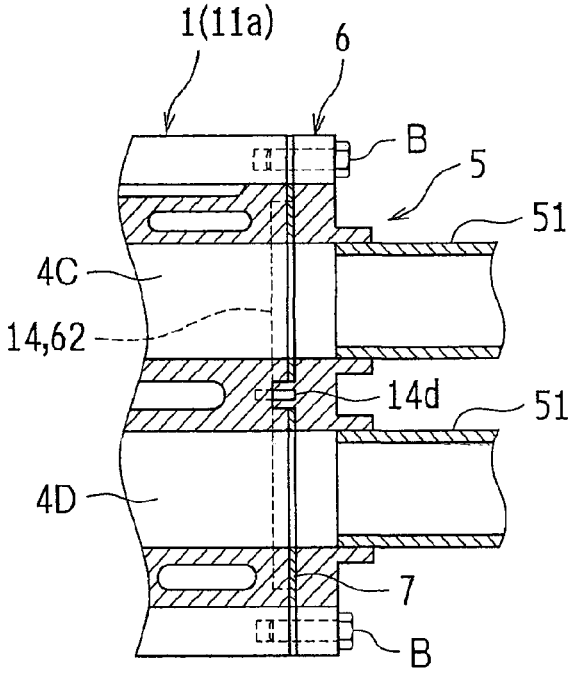
Figure 7:
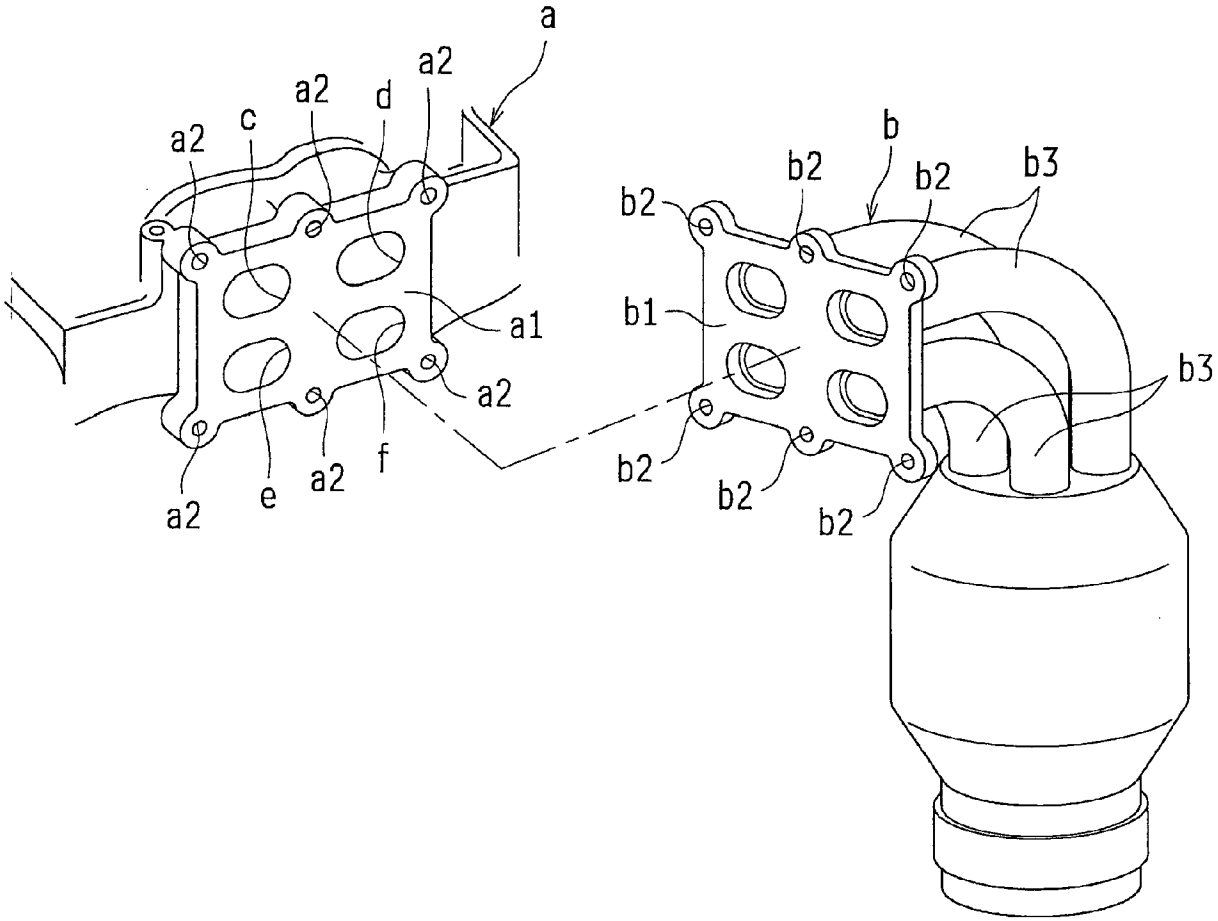
FIG. 7 RELATED ART
FIG. 7 is a perspective view that shows a cylinder head and an exhaust manifold for illustrating a task of the invention.

FIG. 6A and FIG. 6B are cross-sectional views of the cylinder head 1, gasket 7 and exhaust manifold 5, taken along the line VI-VI in FIG. 1, in which FIG. 6A is a view for illustrating work for mounting the exhaust manifold 5 on the cylinder head 1 and FIG. 6B is a view that shows a state where the exhaust manifold 5 is mounted on the cylinder head 1.

In work for mounting the exhaust manifold 5 on the cylinder head 1, first, as shown in FIG. 3 and FIG. 6A, the gasket 7 and the flange 6 of the exhaust manifold 5 are placed sequentially on the fastening seat portion 11*a* provided at the cylinder head 1.

At this time, the exhaust gas openings 72 and the bolt insertion holes 73 provided at the gasket 7 and the exhaust gas introduction openings 6*a* to 6*d* and the bolt holes 61 provided at the flange 6 are positioned with respect to the exhaust port outlets 4*a* to 4*d* and the bolt holes 11*b* provided at the fastening seat portion 11*a*.

At this time, the cross protrusion 62 formed at the flange 6 of the exhaust manifold 5 is inserted through the cross opening 74 of the gasket 7 and is fitted to the cross recess 14 formed in the fastening seat portion 11*a* of the cylinder head 1.

At the time of the fitting work, the knock-pin 14*d* mounted in the cross recess 14 is inserted into the knock-pin hole 62*c* formed in the cross protrusion 62. Thus, the relative locations of these fastening seat portion 11*a* of the cylinder head 1 and flange 6 of the exhaust manifold 5 are positioned.

The bolts B are respectively inserted through the bolt holes 61 formed in the flange 6 of the exhaust manifold 5, the bolt insertion holes 73 formed in the gasket 7 and the bolt holes 11*b* formed in the fastening seat portion 11*a* of the cylinder head 1, and the bolts B are respectively screwed to the bolt holes 11*b* formed in the fastening seat portion 11*a*. Thus, the flange 6 of the exhaust manifold 5 is fastened to the fastening seat portion 11*a* of the cylinder head 1 via the gasket 7 (see FIG. 6B). In this fastened state, the protrusion 62 is fitted over the entire depth in the recess 14, and the degree of adhesion increases through compression deformation of the beads 71 of the gasket 7. Thus, high sealing performance is obtained.

As described above, in the present embodiment, in a state where the exhaust manifold 5 is fastened to the cylinder head 1 by placing the flange 6 on the fastening seat portion 11*a*, the protrusion 62 provided at the flange 6 is fitted to the recess 14 provided at the fastening seat portion 11*a*. That is, a mating face of the fastening seat portion 11*a* of the cylinder head 1 and a mating face of the flange 6 of the exhaust manifold 5 are placed on top of each other by protrusion and recess surfaces. Therefore, a labyrinth structure (seal structure formed through placement of the protrusion and recess surfaces on top of each other) is present between any adjacent two of the exhaust port outlets 4*a* to 4*d* and between any adjacent two of the exhaust gas introduction openings 6*a* to 6*d*, so sealing performance between any adjacent two of the exhaust port outlets 4*a* to 4*d* and between any adjacent two of the exhaust gas introduction openings 6*a* to 6*d* is favorably ensured. Particularly, sealing performance at the center portions of the fastening seat portion 11*a* and flange 6, which cannot be fastened by a bolt, is sufficiently ensured. Therefore, exhaust gas emitted from any one of the exhaust port outlets 4*a* to 4*d* does not flow into the exhaust gas introduction openings 6*a* to 6*d* other than the exhaust gas introduction openings 6*a* to 6*d* corresponding to the any one of the exhaust port outlets 4*a* to 4*d* to influence the exhaust gas emission performance, so it is possible to improve engine efficiency as a result of improvement in exhaust performance.

The relative locations of the fastening seat portion 11*a* of the cylinder head 1 and the flange 6 of the exhaust manifold 5 are positioned in a state where the knock-pin 14*d* is inserted in the knock-pin hole 62*c*, so the mounting location of the exhaust manifold 5 on the cylinder head 1 is appropriately obtained, and a positional deviation does not occur in these relative locations. In addition, the knock-pin 14*d* is provided at the center portion of the fastening seat portion 11*a*, so, even when thermal expansion occurs in the fastening seat portion 11*a* of the cylinder head 1 or the flange 6 of the exhaust manifold 5, the relative locations of these members are appropriately positioned with almost no influence.

When thermal expansion occurs in the cylinder head 1 or the exhaust manifold 5, the relative locations of the bolt B and the bolt hole 61' formed in the oblong hole vary in the extending direction of the oblong hole 61'. That is, thermal expansion of the cylinder head 1 or the exhaust manifold 5 is absorbed by the oblong hole 61', and pressing of the bolt B against the inner periphery of the mounting hole (oblong hole) 61' is suppressed, so it is possible to alleviate thermal stress that acts on the cylinder head 1 and the exhaust manifold 5. In addition, with the configuration that the inside diameter of each of the other bolt holes 61 is set so as to be slightly larger than the inside diameter of a corresponding one of the bolt holes 11*b* formed in the cylinder head 1 as well, it is possible to similarly alleviate thermal stress that acts on the cylinder head 1 and the exhaust manifold 5.

The above-described embodiment is the case where the invention is applied to the four-cylinder gasoline engine mounted on the vehicle. The invention is not limited to this configuration. The invention is applicable to an engine that is applied to a device other than the vehicle. In addition, not limited to the gasoline engine, the invention is applicable to a diesel engine. Furthermore, not limited to the four-cylinder engine, the invention is applicable to a three or less-cylinder engine or a five or more-cylinder engine. In these cases, the recess 14 and the protrusion 62 do not have a cross shape, and a recess and a protrusion are formed in between any adjacent two of the exhaust port outlets and in between any adjacent two of the exhaust gas introduction openings, that is, so as to partition the area in which the exhaust port outlets are formed and to partition the area in which the exhaust gas introduction openings are formed.

In the above embodiment, the recess 14 is provided at the fastening seat portion 11*a* of the cylinder head 1, and the protrusion 62 is provided at the flange 6 of the exhaust manifold 5. The invention is not limited to this configuration. It is also applicable that a protrusion is formed at the fastening seat portion 11*a* of the cylinder head 1, a recess is provided at the flange 6 of the exhaust manifold 5, and the protrusion is fitted to the recess. Furthermore, it is also applicable that a protrusion and a recess are provided at the fastening seat portion 11*a* of the cylinder head 1, a recess and a protrusion are provided at the flange 6 of the exhaust manifold 5 in correspondence with the above protrusion and recess, and the protrusions are respectively fitted to the corresponding recesses.

Furthermore, the arrangement location of the knock-pin 14*d* is not limited to one portion at the center portion of the cross recess 14; a plurality of the arrangement locations may be set as long as it is less likely to receive the influence of thermal expansion of the cylinder head 1. In addition, it is also applicable that a knock-pin is provided at the flange 6 of the exhaust manifold 5 and a knock-pin hole to which the knock-pin is inserted is provided at the fastening seat portion 11*a* of the cylinder head 1.

In the above embodiment, six portions are set as the fastening portions of the flange 6 of the exhaust manifold 5 to the fastening seat portion 11*a* of the cylinder head 1; however, the number of the fastening portions is not specifically limited, and the fastening portions may be set at four portions.

The invention is applicable to a structure for mounting an exhaust manifold on an end face of a cylinder head in which exhaust port outlets are arranged in multiple rows and a plurality of the exhaust port outlets are arranged in each row.

The invention claimed is:

1. An exhaust manifold mounting structure for an internal combustion engine, comprising:

a cylinder head in which exhaust port outlets are arranged in multiple rows and a plurality of the exhaust port outlets are arranged in each row, a fastening seat portion being formed at an end face of the cylinder head, the plurality of exhaust port outlets being arranged at the fastening seat portion; and an exhaust manifold having a plurality of exhaust gas introduction openings corresponding to the exhaust port outlets, the exhaust manifold including a flange in a shape corresponding to the fastening seat portion, the exhaust manifold being mounted on the fastening, seat portion, wherein a recess is provided at one of the fastening seat portion of the cylinder head and the flange of the exhaust manifold in correspondence with an area in between any adjacent two of the exhaust port outlets, and a protrusion that is fitted to the recess is provided at the other one of the fastening seat portion of the cylinder head and the flange of the exhaust manifold, and the exhaust manifold is fastened to the cylinder head by placing the flange of the exhaust manifold on the fastening seat portion of the cylinder head in a state where the protrusion is fitted to the recess.

2. The exhaust manifold mounting structure according to claim 1, further comprising:

a knock-pin provided at a center portion of the fastening seat portion of the cylinder head; and an insertion hole, to which the knock-pin is inserted, and which is provided at a center portion of the flange of the exhaust manifold, wherein the knock-pin is inserted in the insertion hole in a state where the flange of the exhaust manifold is placed on the fastening seat portion of the cylinder head.

3. The exhaust manifold mounting structure according to claim 1, wherein a plurality of mounting holes that allow bolts for fastening the flange to the cylinder head to be inserted are formed at multiple portions of an outer peripheral portion of the flange of the exhaust manifold, and at least one of the plurality of mounting holes is an oblong hole that extends in a direction outward from a center location of the flange.

4. The exhaust manifold mounting structure according to claim 1, wherein the internal combustion engine includes four cylinders, the four exhaust port outlets are arranged in two rows and two in each of the two rows at the fastening seat portion of the cylinder head, and a recess provided at one of the fastening seat portion of the cylinder head and the flange of the exhaust manifold and a protrusion provided at the other one of the fastening seat portion of the cylinder head and the flange of the exhaust manifold each are formed in between the two rows and in between any adjacent two of the exhaust port outlets in each row.

5. The exhaust manifold mounting structure according to claim 1, wherein the recess is provided at the fastening seat portion of the cylinder head, and the protrusion is provided at the flange of the exhaust manifold.

6. The exhaust manifold mounting structure according to claim 1, further comprising:

a gasket interposed between the fastening seat portion of the cylinder-head and the flange of the exhaust manifold, the gasket having an opening through which the protrusion is inserted.

* * * * *